US007704040B2

(12) United States Patent
Yamazaki et al.

(10) Patent No.: US 7,704,040 B2
(45) Date of Patent: Apr. 27, 2010

(54) WATER PUMP

(75) Inventors: Shuhei Yamazaki, Aichi-ken (JP); Moritaka Shibata, Handa (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 181 days.

(21) Appl. No.: 11/487,310

(22) Filed: Jul. 17, 2006

(65) Prior Publication Data

US 2007/0025844 A1 Feb. 1, 2007

(30) Foreign Application Priority Data

Jul. 26, 2005 (JP) ..... 2005-216310

(51) Int. Cl.
*F04D 29/02* (2006.01)

(52) U.S. Cl. ..... 415/168.1; 415/169.2

(58) Field of Classification Search ..... 415/168.2, 415/168.3, 168.4, 168.1, 169.2, 111, 230
See application file for complete search history.

(56) References Cited

U.S. PATENT DOCUMENTS 5,338,153 A 8/1994 Swanson et al.
5,355,847 A 10/1994 Ozeki
5,660,521 A 8/1997 Serio
5,772,396 A 6/1998 Rockwood
6,270,312 B1 * 8/2001 Heer ..... 415/111

FOREIGN PATENT DOCUMENTS

DE 4318158 A1 6/1993
EP 0428210 A1 11/1990
JP 11-336699 5/1998
JP 2004108250 9/2002

OTHER PUBLICATIONS

Office Action from the European Patent Office dated Mar. 20, 2009.

* cited by examiner

*Primary Examiner*—Edward Look
*Assistant Examiner*—Dwayne J White
(74) *Attorney, Agent, or Firm*—Stites & Harbison PLLC; Juan Carlos A. Marquez, Esq.

(57) ABSTRACT

A water pump includes an impeller provided on an end of a rotational shaft supported on a body through a bearing, a mechanical seal provided between the impeller and the bearing, a draining hole guiding a coolant leaked from the impeller side to a reservoir provided at a bottom of the body via the mechanical seal, a vapor outlet provided above the reservoir for establishing communication between the reservoir and the atmosphere, and the draining hole opening to the reservoir at a lower level than the vapor outlet. An axis of the reservoir is offset from a vertical plane which passes through an axis of the rotational shaft.

5 Claims, 2 Drawing Sheets

WATER PUMP

CROSS REFERENCE TO RELATED APPLICATIONS

This application is based on and claims priority under 35 U.S.C. §119 to Japanese Patent Application 2005-216310, filed on Jul. 26, 2005, the entire content of which is incorporated herein by reference.

FIELD OF THE INVENTION

The present invention relates to a water pump, which is applied to a water-cooled engine.

BACKGROUND

A known water pump, which is applied to a water-cooled engine, includes an impeller (17) provided at an end of a rotational shaft (14) supported by a body (11) through a bearing (13), and coolant is circulated in the engine by rotating the rotational shaft (14). A space (19) is formed between the bearing (13) and a mechanical seal (18) provided between the impeller (17) and the bearing (13). Vaporized coolant drops leaking between the mechanical seal (18) and the rotational shaft are condensed in the space (19), and the condensed coolant drops are drained into a reservoir (22*a*) positioned at a bottom portion of the body (11) through a draining hole (22). A plug (23) which plugs up one side of the reservoir (22*a*) is provided at a side of the reservoir (22*a*). A vapor outlet (24), which establishes a communication between the reservoir (22*a*) and the atmosphere, is provided above the plug. An annular groove (27) is formed at the vapor outlet (24) along a sidewall of the reservoir (22*a*) (e.g., described in JPH11-336699A). Alternatively, a water pump includes the draining hole (22) having a stepped portion (22*c*) provided between the vapor outlet (24) and an opening plane (22*b*) of the draining hole (22) opening to the reservoir (22*a*), at which the vapor outlet (24) is positioned above the opening plane (22*b*). According to the foregoing water pump, the draining of the coolant leaking from the draining hole (22) to the atmosphere by running along a top surface of the vapor outlet (24) is prevented (e.g., JP2004-108250A).

However, a mechanical seal of water pumps has characteristics that there is a clearance between a rotational shaft and the mechanical seal, thus generation of leaks of the coolant unavoidably occurs, and thus when the coolant, leaked from the mechanical seal and condensed, is directly drained from the draining hole, a trace of coolant is marked on a body and on other parts. When antifreeze is used for coolant, alcohol components included in antifreeze adversely affect other parts, and coolant leaks are considered as a water pump failure.

Accordingly, with the construction of the water pump described above, leaked coolant is pooled in the reservoir through the draining hole so that the pooled coolant is discharged from the vapor outlet when a predetermined volume of the leaked coolant is reserved. Further, with the water pump described above, the annular groove is provided at the vapor outlet along the sidewall of the reservoir so that the leaked coolant runs along the top surface of the vapor outlet by surface tension to be drained to the atmosphere through the vapor outlet to be guided to the bottom of the reservoir. However, with the construction of the water pump described above, coolant may not be securely guided to the bottom of the reservoir and the reservoir may not be able to reserve adequate volume of the coolant. Possibly, there is a risk that the coolant may be drained to the outside without going through the groove which is supposed to guide the coolant to the bottom in case the leaked coolant is guided to the reservoir by running along the sidewall without dropping as drops from a wall surface at front side of the pump of an outlet to a drain. Further, in case the annular groove is provided along the sidewall of the reservoir, there is a risk that coolant may not be able to be guided to the bottom of the reservoir securely because the leaked coolant dries and adheres to the groove clogging the groove in doing so.

A need thus exists for a water pump, which securely reserves a predetermined volume of leaked coolant in a reservoir, and particularly at which the leaked coolant is not able to drain outwards by running along a sidewall of the reservoir.

SUMMARY OF THE INVENTION

In light of the foregoing, the present invention provides a water pump, which includes an impeller provided on an end of a rotational shaft supported on a body through a bearing, a mechanical seal provided between the impeller and the bearing, a draining hole guiding a coolant leaked from the impeller side to a reservoir provided at a bottom of the body via the mechanical seal, a vapor outlet provided above the reservoir for establishing communication between the reservoir and the atmosphere, and the draining hole opening to the reservoir at a lower level than the vapor outlet. An axis of the reservoir is offset from a vertical plane which passes through an axis of the rotational shaft.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

One embodiment of the present invention will be explained with reference to illustrations of drawing figures as follows.

Figure 1:
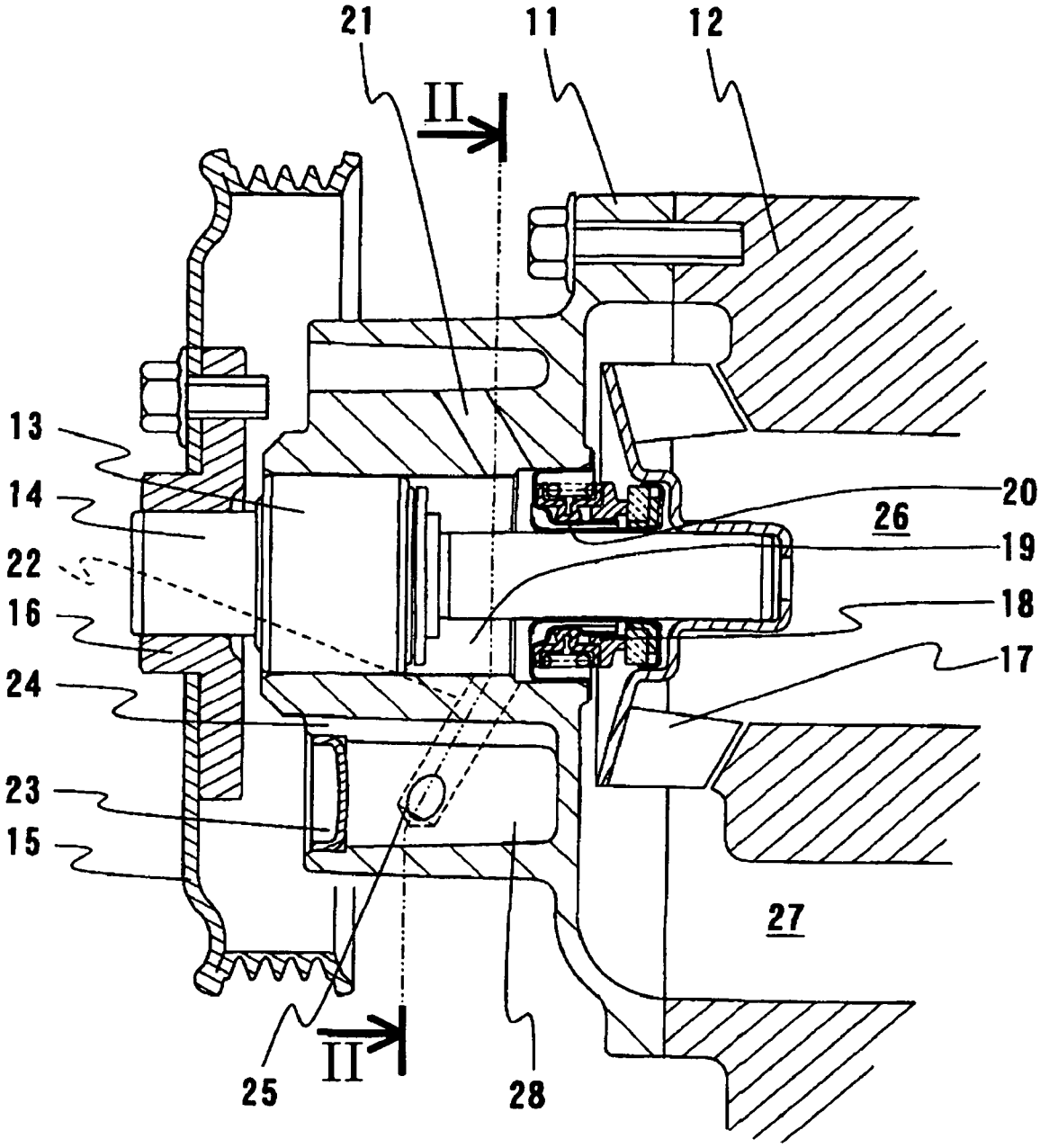
FIG. 1 is a cross-sectional view of a water pump according to an embodiment of the present invention taken on line I-I of FIG. 2.

As shown in FIG. 1, a body 11 is fixed on a cylinder block 12 by means of a fixing member (e.g., a bolt). A rotational shaft 14 is supported on the body 11 through a bearing 13. A driving pulley 15 is fixed on a first end of the rotational shaft 14 through a pulley bracket 16 by means of a fixing member such as a bolt. An impeller 17 is secured to a second end of the rotational shaft 14 by press fitting, and the impeller 17 is rotated by rotational force of the rotational shaft 14. An annular mechanical seal 18 is provided between the impeller 17 and the bearing 13. A space 19 is formed between the mechanical seal 18 and the bearing 13. A slight clearance 20, which is in communication with the space 19 exists between the mechanical seal 18 and the rotational shaft 14. Vaporized coolant drops (leaked coolant) leaks into the space 19 through the clearance 20 from an impeller side where the coolant flows.

The body 11 includes a vapor draining hole 21 which lets vaporized portions of coolant drops out obliquely upward and a draining hole 22 which drains condensed coolant drops obliquely downward.

Figure 2:
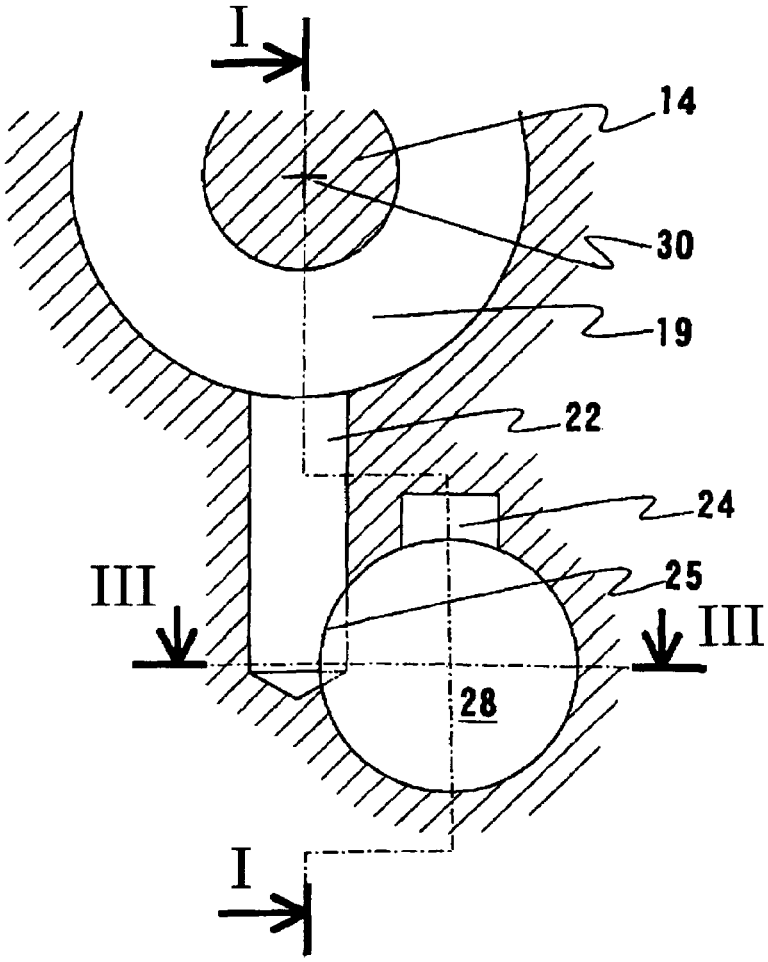
FIG. 2 is a cross-sectional view of the water pump taken on line II-II of FIG. 1.
Figure 3:
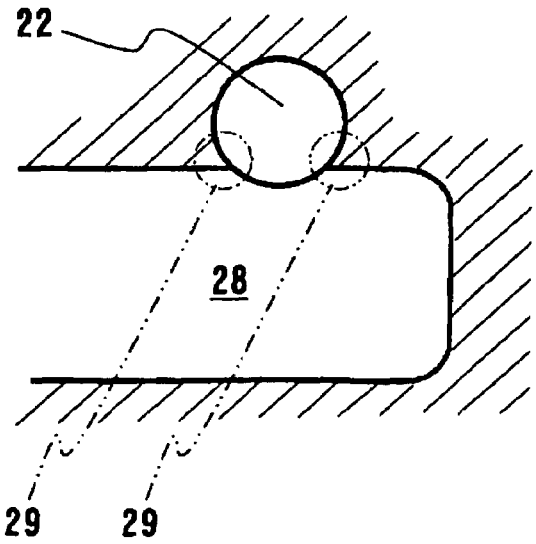
FIG. 3 is a cross-sectional view of the water pump taken on line III-III of FIG. 2.

The draining hole 22 is formed obliquely downward from the space 19, and establishes the communication between the space 19 and a reservoir 28 which is formed in parallel with the rotational shaft 14 at the bottom of the body 11. An opening portion 25 of the draining hole 22 opens downward from a vapor outlet 24 of the reservoir 28. In other words, as shown in FIG. 2, because the reservoir 28 is arranged at an offset position from a position directly below an axis 30 of the rotational shaft 14, the opening portion 25 of the draining hole 22 which is formed obliquely downward from the space 19 opens to a sidewall of the reservoir 28. Accordingly, the opening portion 25 of the draining hole 22 opens at a lower level than the vapor outlet 24 of the reservoir 28.

The reservoir 28 is formed by plugging an opening portion, which opens in the driving pulley 15 at a side portion opposite to the impeller 17, with a plug 23. Further, the vapor outlet 24, which establishes the communication between the reservoir 28 and the atmosphere, is formed on the body 11 above the plug.

Operations of the water pump will be explained as follows. With the water pump according to the embodiment of the present invention, in accordance with the rotation of an external drive source, the rotational shaft 14 is unitarily driven by means of a belt mounted on the driving pulley 15. Upon the rotation of the rotational shaft 14, the impeller 17 which unitarily rotates with the rotational shaft 14 rotates, coolant which is to be supplied to each portion of the engine is sucked from a coolant inlet 26 formed in a cylinder block 12, and discharged from the coolant outlet to be supplied to each portion of the engine.

In this case, vaporized coolant drops leak into the space 19 through the clearance 20 formed between the mechanical seal 18 and the rotational shaft 14, and vaporized coolant drops are drained from the vapor draining hole 21. On the other hand, the condensed coolant dropping from the vapor is guided by the draining hole 22 at the bottom to be reserved in the reservoir 28.

Because the opening portion 25 of the draining hole 22 is positioned at a lower level than the vapor outlet 24, the coolant drops are securely guided to the reservoir 28 and are not able to be directly guided to the vapor outlet 24 by running the wall. Because a burr 29 is formed at the opening portion 25 of the draining hole 22 when machining the draining hole 22, the coolant drops are first guided downward in the draining hole 22 to be drained into the reservoir 28, accordingly, the coolant drops are guided to the reservoir 28 more securely. Further, a part of the draining hole 22 serves as a reservoir, which increases effective volume of the reservoir 28.

Generally, because the temperature of the cylinder block 12 rises during the operation of the water pump, the temperature of the body 11 rises, and coolant reserved in the reservoir 28 vaporizes and evaporates through the vapor outlet 24. Accordingly, the coolant drops do not leak from the reservoir 28 through the vapor outlet 24.

According to the embodiment of the present invention, because a central axis of the reservoir is offset from a vertical plane, which passes through an axis of the rotational shaft, the opening portion of the draining hole is positioned at lower level than the vapor outlet. Accordingly, leaked coolant drops do not run along the wall to be lead to the vapor outlet directly, and can be guided to the reservoir securely.

According to the embodiment of the present invention, because the wall of the reservoir is away from the vertical plane, which passes through the axis of the rotational shaft, the opening portion of the draining hole can be readily formed on the sidewall of the reservoir.

According to the embodiment of the present invention, because the opening portion of the reservoir of the draining hole includes the burr, the leaked coolant is guided downward in the draining hole. Accordingly, the leaked coolant can be guided to the reservoir more securely.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A water pump, comprising;

an impeller provided on an end of a rotational shaft supported on a body through a bearing:

a mechanical seal provided between the impeller and the bearing;

a draining hole guiding a coolant leaked from the impeller side to a reservoir provided at a bottom of the body via the mechanical seal;

a vapor outlet provided above the reservoir for establishing communication between the reservoir and the atmosphere; and the draining hole opening to the reservoir at a lower level than the vapor outlet, the draining hole opening to a side portion of the reservoir, and the side portion being located between an upper portion of the reservoir and a bottom portion of the reservoir.

2. The water pump according to claim 1, wherein a wall surface of the reservoir is away from the vertical plane which passes through the axis of the rotational shaft.

3. The water pump according to claim 1, wherein an opening portion of the reservoir of the draining hole includes a burr.

4. The water pump according to claim 2, wherein an opening portion of the reservoir of the draining hole includes a burr.

5. The water pump of claim 1, wherein the reservoir is offset from the draining hole and a space formed between the bearing and the mechanical seal.

* * * * *